US008656849B2

(12) United States Patent
Magara et al.

(10) Patent No.: US 8,656,849 B2
(45) Date of Patent: Feb. 25, 2014

(54) EMBROIDERY FRAME

(71) Applicants: Midori Magara, Nagoya (JP); Katsuhisa Hasegawa, Kasugai (JP); Harumi Kato, Nagoya (JP)

(72) Inventors: Midori Magara, Nagoya (JP); Katsuhisa Hasegawa, Kasugai (JP); Harumi Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/624,350

(22) Filed: Sep. 21, 2012

(65) Prior Publication Data

US 2013/0074751 A1 Mar. 28, 2013

(30) Foreign Application Priority Data

Sep. 28, 2011 (JP) ..... 2011-213091

(51) Int. Cl.
*D05C 1/04* (2006.01)

(52) U.S. Cl.
USPC ..... 112/103; 112/119

(58) Field of Classification Search
USPC ..... 112/102, 102.5, 103, 118, 119; 33/102.2
See application file for complete search history.

(56) References Cited

U.S. PATENT DOCUMENTS 674,014 A * 5/1901 Parkes ..... 112/103
1,120,357 A 12/1914 Austin
2,989,015 A * 6/1961 Bunsaku Taketomi ..... 112/103
4,247,998 A 2/1981 Foss
4,411,208 A 10/1983 Nishida et al.
4,422,250 A 12/1983 Golan
4,598,655 A 7/1986 Takenoya
4,762,076 A 8/1988 Wakaizumi
4,774,778 A 10/1988 Williams
4,849,902 A 7/1989 Yokoe et al.
4,943,906 A 7/1990 Tajima et al.
4,998,489 A 3/1991 Hisatake et al.
5,144,899 A 9/1992 Allen
5,151,863 A 9/1992 Komuro et al.
5,191,536 A 3/1993 Komuro et al.
5,222,314 A * 6/1993 Inteso ..... 38/102.2
5,261,341 A 11/1993 Asano
5,377,605 A 1/1995 Frye
5,427,043 A 6/1995 Conley, Jr. et al.

(Continued)

FOREIGN PATENT DOCUMENTS

JP A 59-181185 10/1984
JP A 03-193090 8/1991

(Continued)

OTHER PUBLICATIONS

U.S. Appl. No. 13/623,542, filed Sep. 20, 2012.

(Continued)

*Primary Examiner* — Danny Worrell, Jr.
(74) *Attorney, Agent, or Firm* — Oliff PLC

(57) ABSTRACT

An embroidery frame comprises an inner frame, wherein the inner frame is a circular form. The embroidery frame comprises a middle frame which is configured to be detachably attachable to a radial outside of the inner frame. The middle frame is a circular form. The embroidery frame comprises an outer frame which is configured to rotatably hold the middle frame, wherein the outer frame is a circular form, and the outer frame is configured to be detachably attachable to a radial outside of the middle frame. The embroidery frame comprises a grip portion which is provided to the middle frame.

4 Claims, 7 Drawing Sheets

(56) References Cited

U.S. PATENT DOCUMENTS

| | | | | |
|---|---|---|---|---|
| 5,555,828 | A | 9/1996 | Rowley | |
| 5,632,214 | A | 5/1997 | Conley, Jr. et al. | |
| 5,860,374 | A | 1/1999 | Jensen et al. | |
| 5,911,182 | A | 6/1999 | Uyama et al. | |
| 5,970,895 | A | 10/1999 | Mack | |
| 6,000,350 | A | 12/1999 | Koike et al. | |
| 6,095,068 | A * | 8/2000 | Hori | 112/103 |
| 6,119,611 | A | 9/2000 | Tomita | |
| 6,167,822 | B1 | 1/2001 | Miyasako et al. | |
| 6,298,800 | B1 * | 10/2001 | Gala | 112/103 |
| 7,168,378 | B2 | 1/2007 | Fukao | |
| 7,302,308 | B2 | 11/2007 | Kato et al. | |
| 7,359,760 | B2 | 4/2008 | Kishi et al. | |
| 7,542,822 | B2 | 6/2009 | Kawaguchi et al. | |
| 7,561,939 | B2 | 7/2009 | Kawabe et al. | |
| 8,301,292 | B2 | 10/2012 | Tokura | |
| 8,438,984 | B2 * | 5/2013 | Hasegawa et al. | 112/103 |
| 2005/0234585 | A1 | 10/2005 | Muto et al. | |
| 2006/0167581 | A1 | 7/2006 | Kawaguchi et al. | |
| 2007/0225855 | A1 | 9/2007 | Yamada | |
| 2008/0216721 | A1 | 9/2008 | Nagai et al. | |
| 2009/0188413 | A1 | 7/2009 | Hirata et al. | |
| 2009/0188414 | A1 | 7/2009 | Tokura | |

FOREIGN PATENT DOCUMENTS

| | | |
|---|---|---|
| JP | A 05-123464 | 5/1993 |
| JP | U 06-004094 | 1/1994 |
| JP | A 2002-136784 | 5/2002 |

OTHER PUBLICATIONS

U.S. Appl. No. 13/624,336, filed Sep. 21, 2012.
U.S. Appl. No. 13/624,420, filed Sep. 21, 2012.
Dec. 19, 2012 Office Action issued in U.S. Appl. No. 13/624,336.
Sep. 13, 2013 Office Action issued in U.S. Appl. No. 13/624,420.
Sep. 17, 2013 Office Action issued in U.S. Appl. No. 13/623,542.

* cited by examiner

EMBROIDERY FRAME

CROSS-REFERENCE TO RELATED APPLICATION

This application claims priority to Japanese Patent Application No. 2011-213091, filed on Sep. 28, 2011, the disclosure of which is hereby incorporated by reference herein in its entirety.

BACKGROUND

This disclosure relates to an embroidery frame that is configured to be attachable to a sewing machine.

An embroidery frame for a sewing machine is widely known. The embroidery frame is a circular form and the embroidery frame can be rotated to an intended angle. For example, the embroidery frame comprises a pair of embroidery frames and an outer frame. The pair of embroidery frames is configured to hold a work cloth. The outer frame can hold the pair of embroidery frames such that the pair of embroidery frames is rotatable. Indicators which represent angles are provided on the outer frame. The outer frame is mountable to outside of the pair of embroidery frames. For example, the pair of embroidery frame and the outer frame is mountable to the sewing machine.

SUMMARY

As described above, the indicator is provided on the outer frame. As a user of the sewing machine looks at the indicators, the user may rotate the pair of the embroidery frames which holds the work cloth. The user has to fix the pair of embroidery frames at an intended angle by using a screw. Accordingly, the operability of the embroidery frame may not be good.

Various exemplary embodiments of the general principles herein provide an embroidery frame, whose operability is good.

Exemplary embodiments herein provide an embroidery frame that comprises an inner frame, a middle frame, an outer frame, and a grip portion. The inner frame is a circular form. The middle frame is configured to be detachably attachable to a radial outside of the inner frame. The middle frame is a circular form. The outer frame is configured to rotatably hold the middle frame. The outer frame is a circular form. The outer frame is configured to be detachably attachable to a radial outside of the middle frame. The grip portion is provided to the middle frame.

BRIEF DESCRIPTION OF THE DRAWINGS

Embodiments will be described below in detail with reference to the accompanying drawings in which.

DETAILED DESCRIPTION

Figure 1:
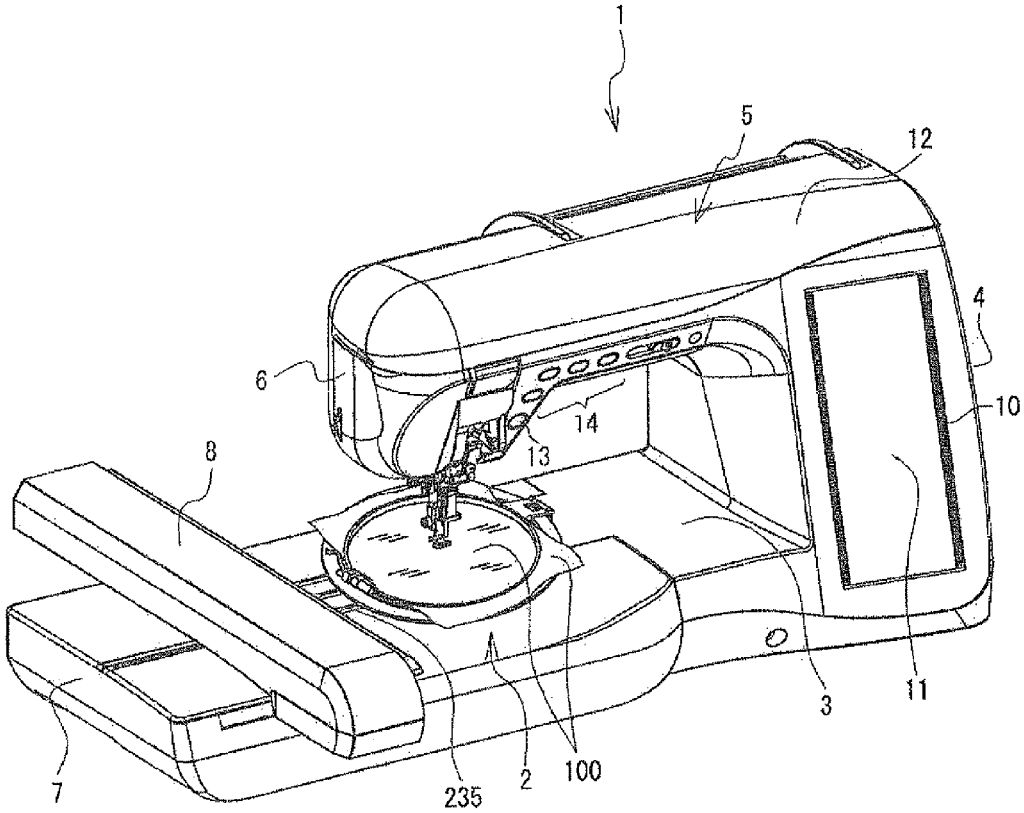
FIG. 1 is an oblique view of a sewing machine.

Hereinafter, an embroidery frame 2 that is an embodiment will be explained with reference to the drawings. In FIG. 1, the side where a user of the sewing machine 1 is positioned is defined as the front side of a sewing machine 1, and the opposite side is defined as the rear side. The left-right direction as seen by the user is defined as the left-right direction of the sewing machine 1. That is a face on which a switch cluster 14 (described below) is provided is the front face of the sewing machine 1. The longitudinal direction of a bed 3 and an arm 5 is the left-right direction of the sewing machine 1. A side on which a pillar 4 is provided is the right side of the sewing machine 1. The direction in which the pillar 4 extends is the up-down direction of the sewing machine 1.

As shown in FIG. 1, the sewing machine 1 includes the bed 3, the pillar 4, the arm 5, and a head 6. The bed 3 is the base of the sewing machine 1 and extends in the left-tight direction. The pillar 4 extends upward from the right end of the bed 3. The arm 5 extends to the left from the upper end of the pillar 4. The head 6 is provided on the left end of the arm 5. A needle plate (not shown in the drawings) is provided in the top face of the bed 3. A feed dog, a cloth feed mechanism, a feed adjustment pulse motor, and a shuttle mechanism, which are not shown in the drawings, are provided inside the bed 3 below the needle plate. The feed dog may move a work cloth that is sewn by a specified feed amount. The cloth feed mechanism may drive the feed dog. The feed adjustment pulse motor may adjust the feed amount.

In a case where embroidery sewing is performed with the sewing machine 1, an embroidery frame 2 that holds a work cloth 100 may be disposed on the top side of the bed 3. An area inside the embroidery frame 2 is an embroidery area in which stitches of an embroidery pattern can be formed. An embroidery frame moving unit 7 that is configured to move the embroidery frame 2 can be mounted on and removed from the bed 3. A carriage cover 8, which extends in the front-rear direction, is provided on the top portion of the embroidery frame moving unit 7. A Y axis moving mechanism (not shown in the drawings) is provided inside the carriage cover 35. The Y axis moving mechanism may move a carriage (not shown in the drawings) in a Y axis direction (the front-rear direction of the sewing machine 1). The embroidery frame 2 can be mounted on and removed front the carriage. A mounting portion (not shown in the drawings), where the embroidery frame 2 can be mounted, is provided to the right side of the carriage. The mounting portion projects to the right from the right side face of the carriage cover 8. An attachment portion 235 (refer to FIG. 2) that is provided on the embroidery frame 2 may be mounted on the mounting portion. The carriage, the Y axis moving mechanism, and the carriage cover 8 may be moved in an X axis direction (the left-right direction of the sewing machine 1) by an X axis moving mechanism (not shown in the drawings). The X axis moving mechanism is provided within the body of the embroidery frame moving unit 7.

The X axis moving mechanism and the Y axis moving mechanism may be respectively driven by an X axis motor and a Y axis motor, which are not shown in the drawings. As the embroidery frame 2 is moved in the X direction and the Y direction, a needle bar (not shown in the drawings) and the shuttle mechanism (not shown in the drawings) may be driven. In this manner, an embroidery sewing operation may be performed that sews a specified embroidery pattern on the work cloth 100 that is held by the embroidery frame 2. In a case where an ordinary pattern, which is not an embroidery pattern, is sewn, the embroidery frame moving unit 7 may be removed from the bed 3. Then ordinary sewing may be performed as the work cloth 100 is moved by the feed dog.

A vertically rectangular liquid crystal display 10 is provided on the front face of the pillar 4. Images of various types of items, such as a plurality of the types of patterns, names of commands that cause various types of functions to be performed, various types of messages, and the like, may be displayed on the liquid crystal display 10. A transparent touch panel 11 is provided on the front face of the liquid crystal display 10. Using a finger or a special touch pen, the user may perform a pressing operation on the touch panel 11. Hereinafter, this operation is referred to as a panel operation. The touch panel 11 detects a position that is pressed by a finger or a special touch pen etc., and the sewing machine 1 determines the item that corresponds to the detected position. Thus, the sewing machine 1 recognizes the selected item. By performing the panel operation, the user can select a pattern to be sewn or a command to be executed.

The structure of the arm 5 will be explained. A cover 12 is attached to the top portion of the arm 5. The cover 12 is axially supported such that the cover 12 can be opened and closed by being rotated about an axis that extends in the left-right direction along the upper rear edge of the arm 5. A thread container portion (not shown in the drawings) is provided underneath the cover 12, that is, in the interior or the arm 5. The thread container portion may contain a thread spool (not shown in the drawings) that supplies an upper thread. The upper thread may be supplied from the thread spool to a sewing needle (not shown in the drawings) through a thread guide that includes a tensioner, a thread take-up spring, a thread take-up lever, and the like, which are not shown in the drawings. The tensioner is provided in the head 6 and is configured to adjust the thread tension. The thread take-up lever may be driven reciprocally up and down and pulls up the upper thread. The sewing needle may be attached to the needle bar (not shown in the drawings). The needle bar is driven such that the needle bar may be moved up and down by a needle bar up-and-down moving mechanism (not shown in the drawings), which is provided inside the head 6. The needle bar up-and-down moving mechanism may be driven by a drive shaft (not shown in the drawings) that is rotationally driven by a sewing machine motor (not shown in the drawings). The switch cluster 14, which includes a sewing start/stop switch 13 and the like, is provided on the lower portion of the front face of the arm 5. The sewing start/stop switch 13 may be used to start or stop the operation of the sewing machine 1, that is, to issue commands to start or stop the sewing.

Figure 2:
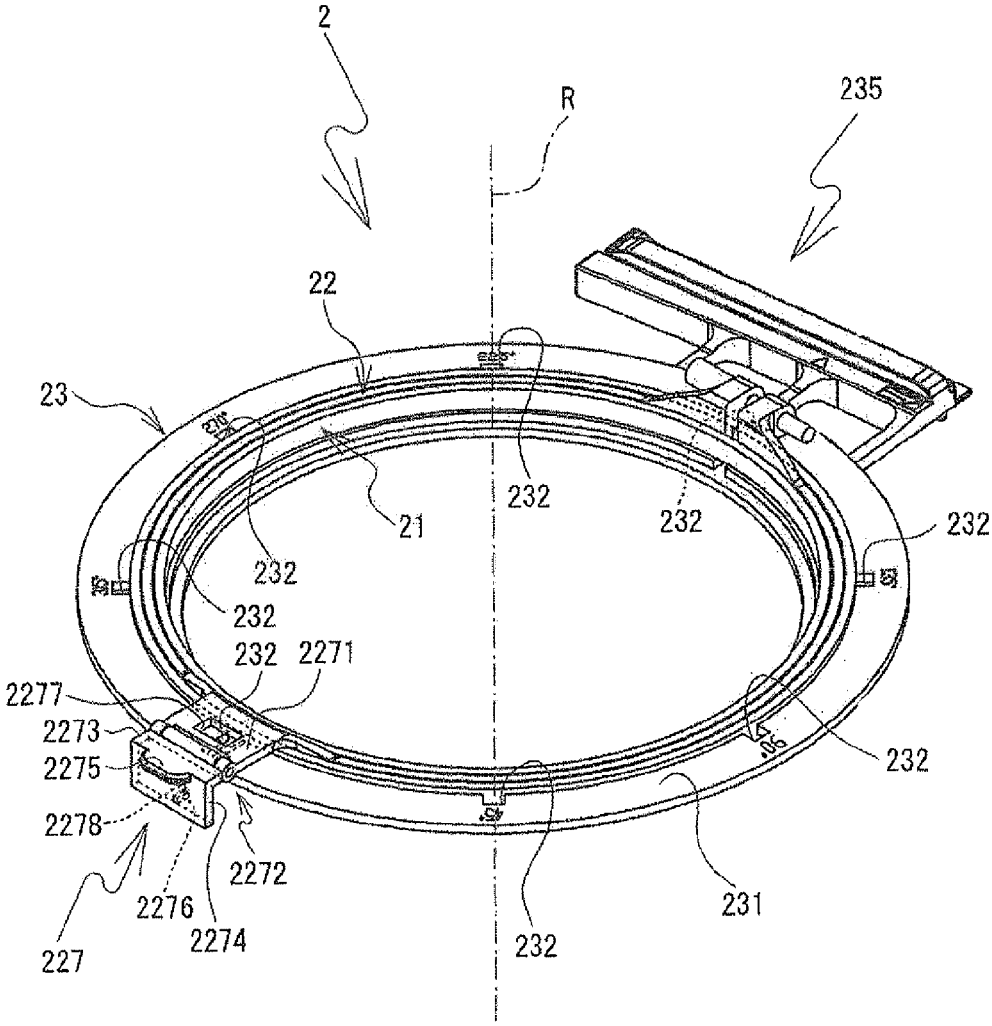
FIG. 2 is an oblique view of an embroidery frame in which a grip portion is in a use position.
Figure 3:
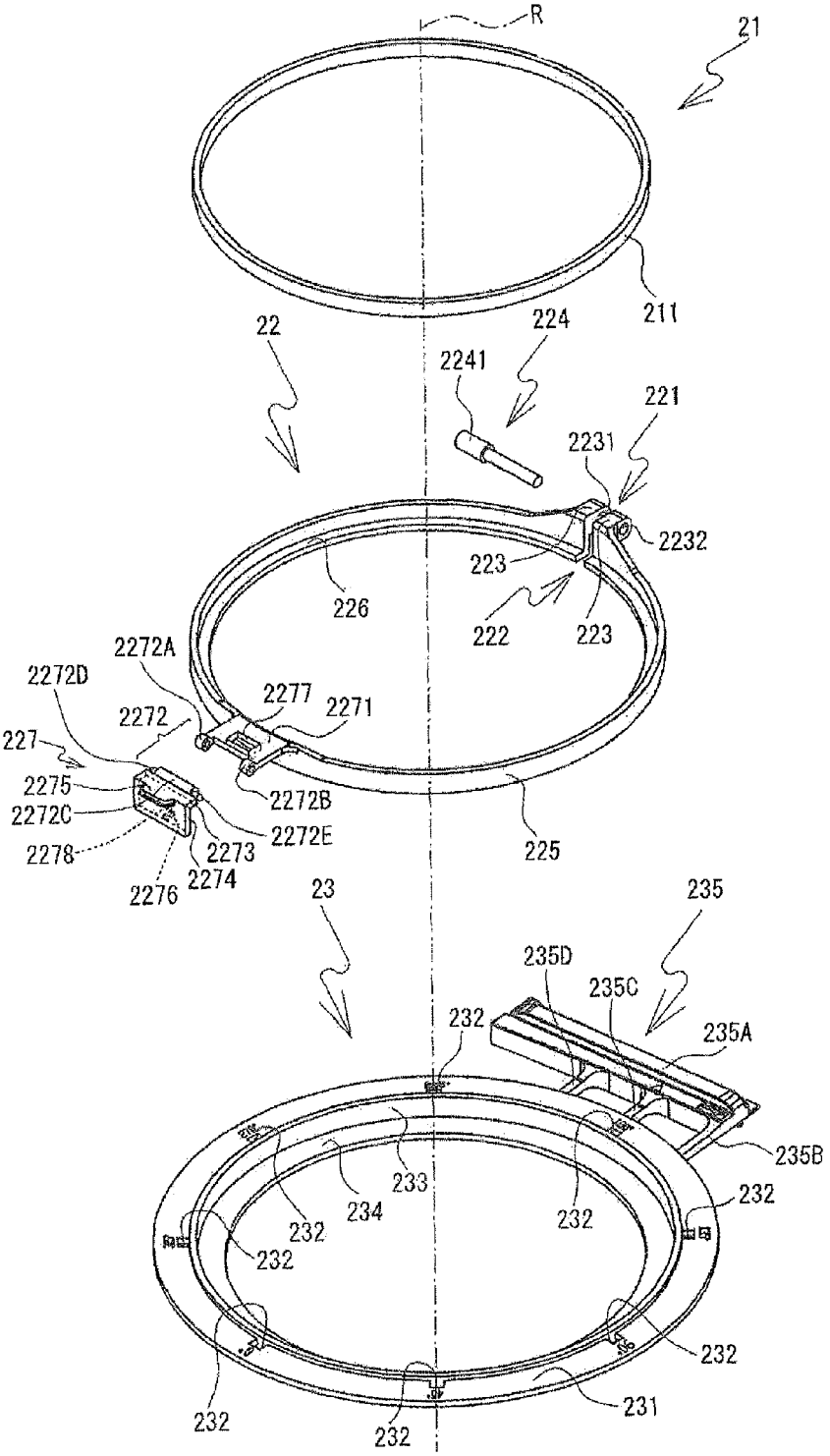
FIG. 3 is an exploded oblique view of an inner frame, a middle frame, and an outer frame.

The embroidery frame 2 will be explained in detail with reference to FIGS. 2 to 7. In the explanation that follows, the up-down direction in FIGS. 2 to 7 is defined as the up-down direction of the embroidery frame 2. As shown in FIGS. 2 and 3, the embroidery frame 2 is formed by combining an inner frame 21, a middle frame 22, and an outer frame 23, each of which is circular. The inner frame 21 and the middle frame 22 can be rotated about a rotation axis R in relation to the outer frame 23. In the embroidery frame 2 according to the present embodiment, the rotation axis R (refer to FIGS. 2 to 7) passes thorough the center of each circle that is formed by each of the inner frame 21, the middle frame 22, and the outer frame 23 (specifically, frame portions 211, 225, and 233, which are described below). Hereinafter, the direction of the rotation axis R is referred to as an "axis direction". The inner frame 21, the middle frame 22, and the outer frame 23 are each formed from a synthetic resin material with comparatively high rigidity. In the embroidery frame 2, the middle frame 22 is disposed to the outside of the inner frame 21 in the radial direction, and the outer frame 23 is disposed to the outside of the middle frame 22 in the radial direction. As shown in FIG. 3, the inner frame 21 includes the circular frame portion 211. The frame portion 211 has a thickness in the axial direction (the up-down direction in FIG. 3).

As shown in FIG. 3, the middle frame 22 includes the frame portion 225, a supporting portion 226, an adjustment portion 221, and a grip portion 227. The frame portion 225 has an inside diameter that is larger than the outside diameter of the frame portion 211 of the inner frame 21. The frame portion 225 has a thickness in the axial direction (the up-down direction in FIG. 3). The frame portion 225 of the middle frame 22 may be mounted on and removed from the outer side in the radial direction of the frame portion 211 of the inner frame 21. Thus, the middle frame 22 may be mounted on and removed from the inner frame 21. The middle frame 22 may be mounted on the inner frame 21. In this case, the work cloth 100 may be clamped between the inner frame 21 and the middle frame 22 (refer to FIGS. 1, 5, and 6). The supporting portion 226 projects toward the inside in the radial direction along the entire inner circumferential side face of the lower edge of the frame portion 225. The supporting portion 226 is a portion that may support the bottom edge face of the inner frame 21.

The adjustment portion 221 may adjust the diameter of the middle frame 22 according to the thickness of the work cloth 100 that is clamped between the inner frame 21 and the middle frame 22. The adjustment portion 221 includes a parting portion 222, a pair of screw mounting portions 223, and an adjusting screw 224. The parting portion 222 is a location where a portion of each of the frame portion 225 and the supporting portion 226 of the middle frame 22 is discontinuous in the thickness direction (i.e. the axial direction). The pair of the screw mounting portions 223 are provided on opposite sides of the parting portion 222. The pair of the screw mounting portions 223 projects to the outside in the radial direction and is positioned such that the screw mounting portions 223 are opposite one another. Holes 2231, 2232 are provided in the pair of the screw mounting portions 223. Each of the holes 2231, 2232 passes through one of the pair of the screw mounting portions 223 in a direction that is orthogonal to the axial direction (the up-down direction in FIG. 3). Of the two holes 2231, 2232, a threaded hole is formed in the hole 2232. The adjusting screw 224 is provided with head portion 2241, which projects outward in the radial direction of the adjusting screw 224 at one end of the adjusting screw 224. In a case where the diameter of the middle frame 22 is adjusted according to the thickness of the work cloth 100, first, the adjusting screw 224 may be inserted from the hole 2231, in which a threaded hole is not formed, toward the hole 2232, in which the threaded hole is formed. Then the adjusting screw 224 may be rotated and may pass through the inside of the hole 2232. At this time, the head 2241 of the adjusting screw 224 may press against the screw mounting portions 223, so that the size of the gap between the pair of the screw mounting portions 223 may be changed. That is, the adjusting screw 224 may connect the pair of the screw mounting portions 223 and may adjust the gap between the pair of the screw mounting portions 223. The diameter of the middle frame 22 may be adjusted according to the thickness of the work cloth 100 by adjusting the gap between the pair of the screw mounting portions 223. For example, the diameter of the middle frame 22 becomes greater to the extent that the gap between the pair of the screw mounting portions 223 becomes wider. Therefore, in this case, a thicker work cloth 100 may be clamped between the middle frame 22 and the inner frame 21.

As shown in FIGS. 2 and 3, the grip portion 227 extends to the outside in the radial direction from an edge in the axial direction of the frame portion 225 (the upper edge of the frame portion 225 in the present embodiment). As described above, in the present embodiment, the axial direction corresponds to the up-down direction of the embroidery frame 2. The grip portion 227 is provided on one of the upper edge and the bottom edge of the frame portion 225 (the upper edge in the present embodiment). The user may grip the grip portion 227 and may rotate the middle frame 22 in relation to the outer frame 23. The grip portion 227 includes a supporting portion 2271, a window portion 2277, a hinge portion 2272, a first arm portion 2273, a second arm portion 2274, a lug portion 2275, a projecting portion 2276, and a hook portion 2278.

The supporting portion 2271 has a rectangular plate shape and extends toward the outside in the radial direction from the upper edge of the frame portion 225 of the middle frame 22, at least as far as an outer edge of an outer circumferential portion 231 of the outer frame 23. The window portion 2277 is a rectangular through-hole that is provided in the supporting portion 2271. The hinge portion 2272 is provided on the outer edge of the supporting portion 2271. The hinge portion 2272 includes a first hole 2272A, a second hole 2272B, a shaft portion 2272C, a first projecting portion 2272D, and a second projecting portion 2272E. The first hole 2272A and the second hole 2272B are provided at opposite ends of the outer edge of the supporting portion 2271 such that the first hole 2272A and the second hole 2272B face one another. The cylindrical shaft portion 2272C is provided along an edge of the rectangular plate-shaped first arm portion 2273. The shaft portion 2272C is shorter than the edge of the first arm portion 2273. The first projecting portion 2272D and the second projecting portion 2272E project outward from opposite ends of the shaft portion 2272C. The shaft portion 2272C, the first projecting portion 2272D, the second projecting portion 2272E, the first arm portion 2273, the second arm portion 2274, the lug portion 2275, the projecting portion 2276, and the hook portion 2278 are formed as a single unit from a synthetic resin material that has lower rigidity than the middle frame 22 and that is slightly flexible. The first arm portion 2273 is axially supported by the supporting portion 2271 by taking advantage of the flexibility of the material to fit the first projecting portion 2272D into the first hole 2272A and then fit the second projecting portion 2272E into the second hole 2272B. In other words, the supporting portion 2271 and the first arm portion 2273 are connected via the hinge portion 2272 such that the first arm portion 2273 can be rotated.

Figure 7:
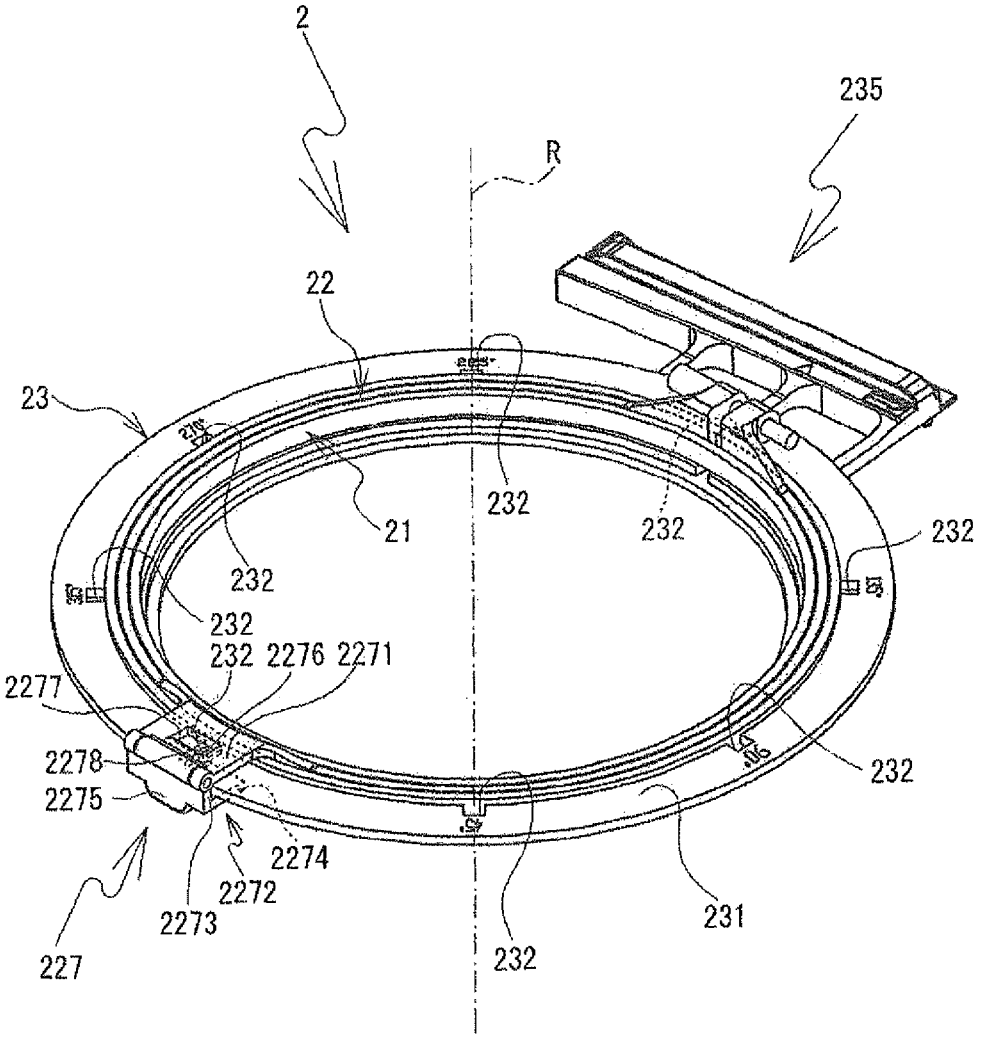
FIG. 7 is an oblique view of the embroidery frame in which the grip portion is in the stowed position.

The second arm portion 2274 is connected to the edge of the first arm portion 2273 that is on the opposite side from the edge where the shaft portion 2272C is provided. The second arm portion 2274 extends at a right angle from the first arm portion 2273. The lug portion 2275 is provided in the location where the first arm portion 2273 and the second arm portion 2274 are connected. The lug portion 2275 projects in the same direction as the direction in which the first arm portion 2273 extends and at a right angle to the direction in which the second arm portion 2274 extends. The projecting portion 2276 is provided in a central portion of the edge of the second arm portion 2274. The projecting portion 2276 projects in a direction that is orthogonal to the direction in which the second arm portion 2274 extends, such that the projecting portion 2276 is opposite the first arm portion 2273. The hook portion 2278 projects from the edge of the projecting portion 2276 in a direction that is orthogonal to the direction in which the projecting portion 2276 projects, such that the hook portion 2278 is opposite the second arm portion 2274. As described above, the first arm portion 2273 can be rotated around the hinge portion 2272. Therefore, the grip portion 227 can be switched between a use position and a stowed position. Specifically, the grip portion 227 is in the use position in a case where the first arm portion 2273 is oriented in the same direction as the direction in which the supporting portion 2271 extends, as shown in FIG. 2. The grip portion 227 is in the stowed position in a case where the first arm portion 2273 is oriented in a direction that is parallel to a side face of the outer circumferential portion 231 and is orthogonal to the direction in which the supporting portion 2271 extends, as shown in FIG. 7. The operations of the grip portion 227 when the grip portion 227 is in the use position and when the grip portion 227 is in the stowed position will be described in detail below.

As shown in FIG. 3, the outer frame 23 includes the frame portion 233, the outer circumferential portion 231, a plurality of throughholes 232, a supporting portion 234, and the attachment portion 235. The frame portion 233 has an inside diameter that is larger than the outside diameter of the frame portion 225 of the middle frame 22. The frame portion 233 has a thickness in the axial direction (the up-down direction in FIG. 3). The outer circumferential portion 231 is a ring-shaped member that extends toward the outside in the radial direction around the entire circumference of one edge of the frame portion 233 in the axial direction (the upper edge in the present embodiment) that is on the same side as the grip portion 227 of the middle frame 22. The plurality of the through-holes 232 are provided in positions that respectively correspond to a plurality of predetermined rotation angles around the circumference of the middle frame 22 (angles of rotation in relation to the outer frame 23). The plurality of the through-holes 232 are holes that pass through the outer circumferential portion 231 of the outer frame 23 in the up-down direction. The through-holes 232 are provided at 45-degree intervals as seen from the central axis of the outer frame 23. The rotation angle of each of the through-holes 232 is indicated, on the upper face of the outer circumferential portion 231, at the outside of the through-hole 232 in the radial direction. In the present embodiment, the middle frame 22 can be locked in relation to the outer frame 23 at any one of the predetermined rotation angles (zero degrees, 45 degrees, 90 degrees, 135 degrees, 180 degrees, 225 degrees, 270 degrees, 315 degrees) by engaging the projecting portion 2276 of the grip portion 227 of the middle frame 22 with the corresponding one of the plurality of the through-holes 232.

The supporting portion 234 is provided on the inner circumferential face of the frame portion 233. The supporting portion 234 projects, in the center of the up-down direction of the frame portion 233, toward the inside in the radial direction along the entire circumference of frame portion 233. The supporting portion 234 is a portion that may support the bottom face of the supporting portion 226 of the middle frame 22. The attachment portion 235 is provided to the outside of the frame portion 233 in the radial direction. The attachment portion 235 includes a body portion 235A, a first connecting portion 235B, a second connecting portion 235C, and a third connecting portion 235D. The body portion 235A, which has a long, narrow, rectangular shape, may be mounted on the mounting portion (not shown in the drawings) of the carriage, which is provided inside the carriage cover 8 of the sewing machine 1. The first connecting portion 235B, the second connecting portion 235C, and the third connecting portion 235D have rectangular columnar shapes and connect the body portion 235A to the frame portion 233 of the outer frame 23.

Figure 4:
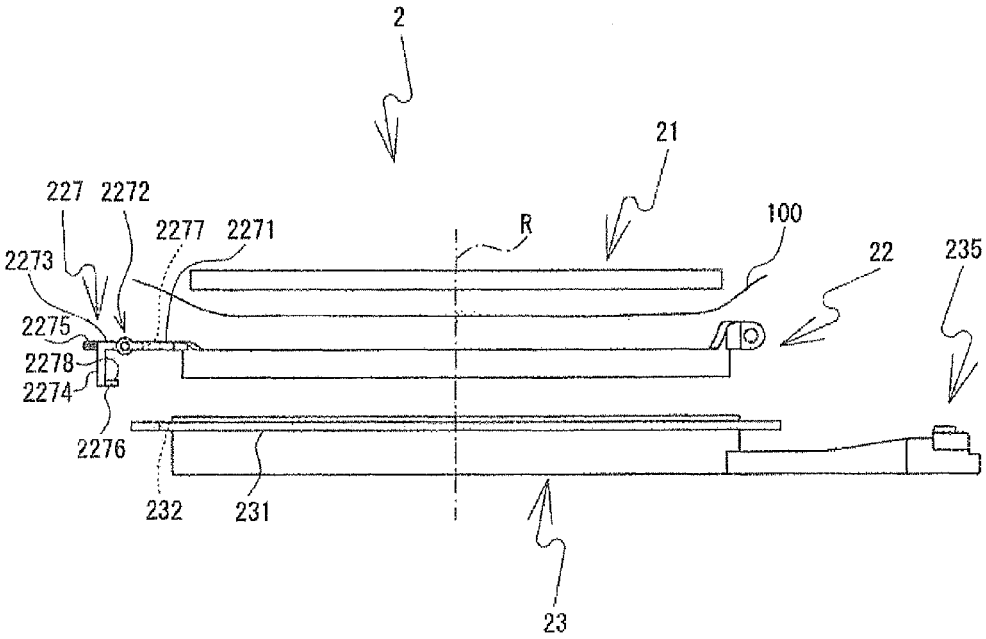
FIG. 4 is a side view for explaining an arrangement of the inner frame, the middle frame, the outer frame, and a work cloth.

The form in which the embroidery frame 2 is used when the work cloth 100 is held by the embroidery frame 2 will be explained with reference to FIGS. 2 and 4 to 7. As shown in FIG. 4, in the embroidery frame 2, starting from the top in the axial direction of the inner frame 21 (the up-down direction in FIG. 4), the inner frame 21, the work cloth 100, the middle frame 22, and the outer frame 23 may be disposed in order. First, the parting portion 222 of the middle frame 22 may be widened as necessary by rotating the adjusting screw 224. That is, the middle frame 22 may be adjusted such that the diameter of the middle frame 22 is increased as necessary. Next, the work cloth 100 may be placed between the middle frame 22 and the inner frame 21, and the inner frame 21 may be fitted into the middle frame 22. Then the adjusting screw 224 may be rotated in the direction that reduces the diameter of the middle frame 22 in accordance with the thickness of the work cloth 100. The work cloth 100 may thus be clamped between the middle frame 22 and the inner frame 21. Next, in a state in which the grip portion 227 of the middle frame 22 is in the use position, the middle frame 22, into which the inner frame 21 has been fitted such that the work cloth 100 is clamped, may be fitted into the outer frame 23. In the state in which the grip portion 227 is in the use position, the first arm portion 2273 of the grip portion 227 extends in the same direction in which the supporting portion 2271 extends. The bottom face of the supporting portion 226 of the middle frame 22 may thus be a state of being supported by the supporting portion 234 of the outer frame 23.

Figure 5:
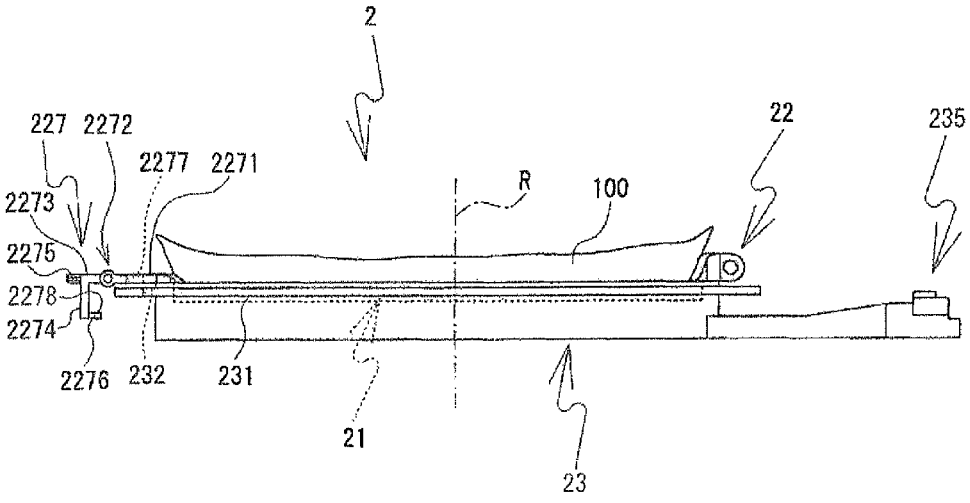
FIG. 5 is a side view or the embroidery frame in a state in which the grip portion is in the use position and the work cloth is clamped.
Figure 6:
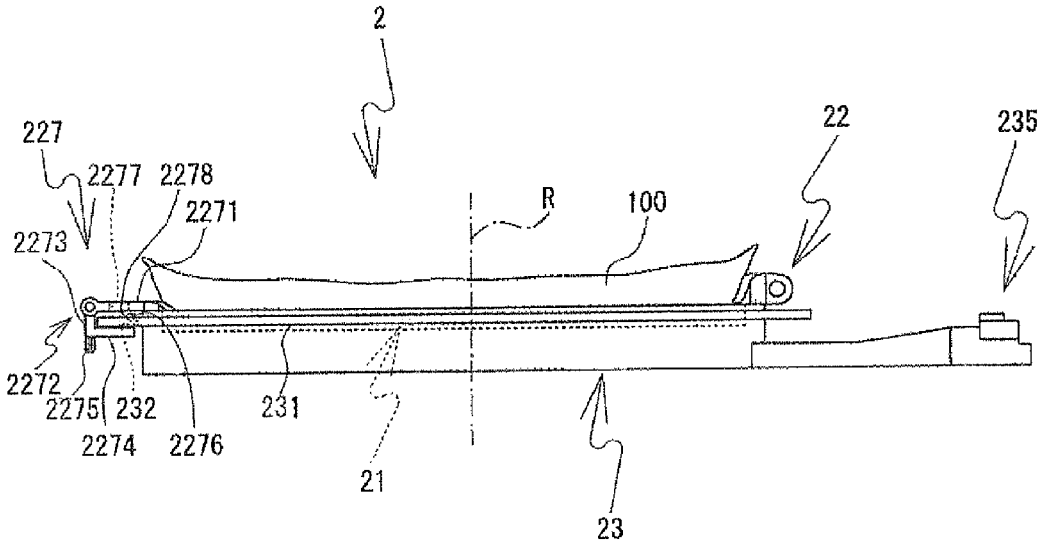
FIG. 6 is a side view of the embroidery frame in a state in which the grip portion is in a stowed position and the work cloth is clamped.

A case in which the grip portion 227 is in the use position and a case in which the grip portion 227 is in the stowed position will be explained with reference to the drawings. The grip portion 227 is in the use position in a case where the first arm portion 2273 extends in the same direction in which the supporting portion 2271 extends and the first arm portion 2273 projects to the outside in the radial direction from the upper edge of the middle frame 22, as shown in FIGS. 2 and 5. In this case, the grip portion 227 projects from the middle frame 22 in a way that allows the grip portion 227 to be gripped. At this time, the second arm portion 2274 is set apart from the outer circumferential portion 231 and extends downward. The projecting portion 2276 cannot be engaged with any one of the plurality of the through-holes 232. Therefore, the middle frame 22 can be rotated in relation to the outer frame 23. In this case, the user may rotate the middle frame 22 in relation to the outer frame 23 by gripping one of the first arm portion 2273 and the second arm portion 2274. While rotating the middle frame 22, the user may look through the window portion 2277 and may visually check one of the rotation angles that are indicated, on the upper face of the outer circumferential portion 231, at the outside of the plurality of the through-holes 232 in the radial direction. In contrast, as shown in FIGS. 6 and 7, the grip portion 227 is in the stowed position in a case where the first arm portion 2273 extends at a right angle to the supporting portion 2271 and extends downward parallel to the side face of the outer circumferential portion 231, and the second arm portion 2274 is placed below the bottom face of the outer circumferential portion 231. In addition, the projecting portion 2276 and the hook portion 2278 are engaged with one of the plurality of the through-holes 232, which are provided in the outer circumferential portion 231 of the outer frame 23. In this case, the middle frame 22 cannot be rotated in relation to the outer frame 23. In other words, the grip portion 227 is in a state in which the grip portion 227 cannot be gripped. As described above, the projecting portion 2276 and the hook portion 2278 are formed from a synthetic resin material that has flexibility. Therefore, when the projecting portion 2276 and the hook portion 2278 are engaged with one of the through-holes 232, the hook portion 2278 is slightly caught on the edge of the through-hole 232. The state in which the projecting portion 2276 and the hook portion 2278 are engaged with the one of the through-holes 232 is thus maintained. In this ease, the embroidery frame 2 may be mounted on the sewing machine 1, and the work of embroidery sewing may be performed.

For example, a case is considered in which the middle frame 22 is fixed in relation to the outer frame 23 in the position where the rotation angle is zero degrees. The user may place the work cloth 100 between the inner frame 21 and the middle frame 22 and may clamp the work cloth 100 with the inner frame 21 and the middle frame 22. Next, the user may fit the middle frame 22, into which the inner frame 21 has been fitted, into the outer frame 23 and may put the grip portion 227 into the use position, as shown in FIGS. 2 and 5. The user may grip one of the first arm portion 2273 and the second arm portion 2274 and may rotate the middle frame 22 in relation to the outer frame 23. Through the window portion 2277, the user may visually cheek one of the rotation angles that is indicated on the upper face of the outer circumferential portion 231 and may rotate the middle frame 22 to the position where the rotation angle becomes zero degrees. Then the user may rotate the grip portion 227 around the hinge portion 2272 and may engage the projecting portion 2276 and the hook portion 2278, which are provided on the edge of the second arm portion 2274, with the through-hole 232 that corresponds to the rotation angle of zero degrees. This completes the switching of the grip portion 227 from the use position to the stowed position. The grip portion 227 may fix the middle frame 22 at the position where the rotation angle is zero degrees such that the middle frame 22 cannot rotate in relation to the outer frame 23. The user may mount the embroidery frame 2, in which the middle frame 22 has been fixed such that the middle frame 22 cannot be rotated, on the sewing machine 1, and the embroidery sewing may be performed.

For example, a case is considered in which, after the embroidery sewing has been performed as described above, the middle frame 22 is fixed in relation to the outer frame 23 at the position where the rotation angle is 45 degrees, and the embroidery sewing is performed. The user may remove the embroidery frame 2 from the sewing machine 1, may place the user's finger on the lug portion 2275, and may rotate the first arm portion 2273 via the hinge portion 2272. The projecting portion 2276 and the hook portion 2278, which had been engaged with the through-hole 232 at the zero-degree position, may thus be separated from the through-hole 232 at the zero-degree position and may enter a disengaged state. In this way, the user may switch the grip portion 227 from the stowed position to the use position. The user may grip one of the first arm portion 2273 and the second arm portion 2274 and may rotate the middle frame 22 in relation to the outer frame 23. Visually checking one of the rotation angles through the window portion 2277, the user may switch the grip portion 227 from the use position to the stowed position at the position where the rotation angle is 45 degrees, then may mount the embroidery frame 2 on the sewing machine 1. By utilizing the grip portion 227 in this manner, the user may repeat the rotating of the middle frame 22 and the performing of the embroidery sewing. Thus, it is possible to perform the embroidery sewing after the middle frame 22 is rotated to the desired angle.

As explained above, with the embroidery frame 2 according to the present embodiment, in a case where the grip portion 227 is in the use position, the user may rotate the middle frame 22 in relation to the outer frame 23 by gripping one of the first arm portion 2273 and the second arm portion 2274, which are included in the grip portion 227 of the middle frame 22. The operability when the middle frame 22 is rotated in relation to the outer frame 23 can thus be improved. In addition, the grip portion 227 can be switched from the use position to the stowed position by fitting the projecting portion 2276 and the hook portion 2278, which are provided in the grip portion 227, into one of the plurality of the through-holes 232, which are provided in the outer circumferential portion 231 of the outer frame 23 such that the plurality of the through-holes 232 respectively correspond to the plurality of the rotation angles. The rotation angle of the middle frame 22 in relation to the outer frame 23 can thus be set accurately and easily. Furthermore, because the grip portion 227 is stowed along the outer frame 23, it is possible to prevent the grip portion 227 from interfering with another member while the work of the embroidery sewing is being performed.

Various types of modifications may be made to the embodiment described above. For example, in the embodiment described above, the grip portion 227 that is provided on the middle frame 22 of the embroidery frame 2, which includes the inner frame 21, the middle frame 22, and the outer frame 23, can be switched between the use position and the stowed position. The grip portion 227 may not be switched between the use position and the stowed position, for example. A member that projects slightly farther to the outside of the frame portion 225 in the radial direction than does the supporting portion 2271 in the embodiment described above may be used as a grip portion, for example.

In the embodiment described above, an example is explained in which the supporting portion 2271 of the grip portion 227 projects to the outside of the middle frame 22 in the radial direction. The grip portion 227 may project from the middle frame 22 in any direction that at least does not interfere with the outer frame 23 when the grip portion 227 is in the use position. Furthermore, in the embodiment described above, the work cloth 100 may be clamped by the inner frame 21 and the middle frame 22, as shown in FIGS. 5 and 6. Considering the placement of the clamped work cloth 100, is preferable for the grip portion 227 not to project to the inside of the frame portion 225 of the middle frame 22. Therefore, the grip portion 227 may project upward in parallel to the axial direction of the middle frame 22. The grip portion 227 may project in any direction within the range from outward in the radial direction of the middle frame 22 to the upward direction of the middle frame 22, for example.

The angles at which the plurality of the through-holes 232 are provided are not limited to the 45-degree intervals in the embodiment described above. The intervals for the angles at which the plurality of the through-holes 232 are provided may be at an angle that is greater than 45 degrees or may be at an angle that is less than 45 degrees.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

an inner frame, the inner frame being a circular form;

a middle frame configured to be detachably attachable to a radial outside of the inner frame, the middle frame being a circular form;

an outer frame configured to rotatably hold the middle frame, the outer frame being a circular form, the outer frame being configured to be detachably attachable to a radial outside of the middle frame, the outer frame having a plurality of first engagement portions; and a grip portion which is provided to the middle frame, the grip portion having a second engagement portion configured to engage with any one of the plurality of the first engagement portions, wherein the grip portion is configured to be switchable to either a first position or a second position, the first position representing a position in which the grip portion is configured to project radially outward of the middle frame, and the second position representing a position in which the grip portion is configured to be stowed along the outer frame, the second engagement portion is configured to engage with any one of the plurality of the first engagement portions in the second position; and the middle frame is configured to be rotatable with respect to the outer frame in the first position.

2. The embroidery frame according to claim 1, wherein the grip portion is configured to be grippable to rotate the middle frame with respect to the outer frame.

3. The embroidery frame according to claim 1, wherein the plurality of the first engagement portions are provided in positions that correspond to a plurality of predetermined rotation angles of the middle frame with respect to the outer frame.

4. The embroidery frame according to claim 3, wherein the outer frame further comprises:

an outer circumferential portion which extends radially outward of the outer frame and is provided at one edge of the outer frame in a rotation axis direction of the outer frame;

wherein the plurality of first engagement portions comprise a plurality of holes which are provided along a circumferential direction of the outer circumferential portion, wherein the plurality of the holes are provided in positions that correspond to the plurality of the predetermined rotation angles;

wherein the grip portion further comprises:

a supporting portion which extends radially outward of the middle frame, from one edge of the middle frame in a rotation axis direction of the middle frame to an outer edge of the outer circumferential portion, wherein the one edge of the middle frame is provided at the same side of the outer circumferential portion of the outer frame;

a hinge portion which is provided at an edge of the supporting portion;

a first arm portion configured to be connectable to the supporting portion via the hinge portion, and configured to be switchable to either the first position or the second position;

a second arm portion which extends toward a first direction crossing the first arm portion; and a lug portion which projects toward a second direction to which the first arm portion extends and is provided at a particular position where the first arm portion and the second arm portion are connected;

wherein the second engagement portion comprises a projecting portion which is provided at an edge of the second arm portion and is opposite of the first arm portion, wherein the projecting portion projects along the first arm portion; and wherein the projecting portion is configured to engage with any one of the plurality of holes in the second position.

* * * * *